US005850669A

United States Patent [19]

Schupp et al.

[11] Patent Number: 5,850,669

[45] Date of Patent: Dec. 22, 1998

[54] VACUUM CLEANER HEAD

[75] Inventors: Andreas Schupp; Timmy Hok Yin Sin, both of New Territories, Hong Kong

[73] Assignee: Techtronic Industries Co., Ltd., Hong Kong

[21] Appl. No.: 795,336

[22] Filed: Feb. 4, 1997

[30] Foreign Application Priority Data

Feb. 7, 1996 [GB] United Kingdom ..... 9602422
Jun. 27, 1996 [GB] United Kingdom ..... 9613493

[51] Int. Cl.[6] ..... A47L 5/24; A47L 9/06

[52] U.S. Cl. ..... 15/366; 15/350; 15/393; 15/398

[58] Field of Search ..... 15/398, 393, 350, 15/366

[56] References Cited

U.S. PATENT DOCUMENTS 1,094,579 4/1914 Matchette ..... 15/398 X
5,235,722 8/1993 Harris et al. ..... 15/398 X
5,313,687 5/1994 Schneider ..... 15/398 X
5,440,782 8/1995 Yamashita ..... 15/398 X
5,617,610 4/1997 Dearaujo ..... 15/350 X
5,638,572 6/1997 Ferrari .
5,722,112 3/1998 Scanni et al. ..... 15/350 X

*Primary Examiner*—Chris K. Moore
*Attorney, Agent, or Firm*—Miller, Sisson, Chapman & Nash, P.C.

[57] ABSTRACT

A vacuum cleaner head, for attachment directly to a vacuum cleaner body having a central longitudinal axis, has exposed bristles with remote ends on a plane off-set by about 70° to the central axis. The bristles extend along opposing sides of a lower surface of the head in strips at either side of a channel through which dust and debris gathered up by the bristles passes into the vacuum body. The off-set plane means that when the body is held directly or by a handle, a natural comfortable sweeping action, with the handle axis at about 20° to the vertical, keeps both strips of bristle in contact with the swept surface.

5 Claims, 2 Drawing Sheets

VACUUM CLEANER HEAD

The invention relates to a vacuum cleaner heads.

It is already known to provide vacuum cleaner head having bristles and arranged so that dust and debris disturbed in use by brushing over a surface is drawn into a vacuum cleaner. The bristled head is usually fitted to an end of a rigid tube which is in turn connected via a flexible tube to a vacuum cleaner body. The bristled head may be somewhat loosely connected to the rigid tube to provide some relative movement during use of the vacuum cleaner. There is an inherent advantage to be gained by fitting a bristled head directly to a vacuum cleaner body to save space, and the cost of the rigid and flexible tubes, especially for relatively small or hand-holdable vacuum cleaners. If a known head is fitted directly to a vacuum body, the handling of the vacuum cleaner in use is cumbersome and it is specially difficult to control and carry out an efficient sweeping action, for example.

It is an object of the invention to overcome or at least reduce this disadvantage.

According to the invention there is provided a vacuum cleaner head adapted to be attached directly to a vacuum cleaner body having a central longitudinal axis and incorporating an electric motor, a fan and dust collecting compartment, the head comprising a generally rectangular hollow housing that has an upper surface that fits against an outer surface of the body and a lower surface that provides rubbing contacts with the ground in use, in which the rubbing contacts are formed in a plane off-set from the central axis by about 70° and are disposed along two opposing sides of the lower surface to form a gap therebetween to allow dust and debris to enter the vacuum cleaner body through the head.

The rubbing contacts may be formed of bristles mounted in two rows to the head extending along respective opposing sides.

The rubber contacts may include one or more elongate resilient pads mounted parallel to the respective rows of bristles and closer to the central axis than the one or two rows of bristles.

The vacuum cleaner head may include a central passage formed in the head having an inlet surface that lies generally on the same plane as the rubbing contacts.

The inlet may be elliptical in cross section and centred about the central axis with the major axis of the ellipse extending along between the rubbing contacts.

The central passage preferably extends across a substantial length of the head at the inlet and reduces in width to equal about one fifth of the length of the head at an outlet of the central passage.

Exposed resilient snap connectors may be provided that fit and hold the head securely to the body of the vacuum cleaner in use.

A vacuum cleaner head according to the invention will now be described by way of example with reference to the accompanying drawings in which.

Figure 1:
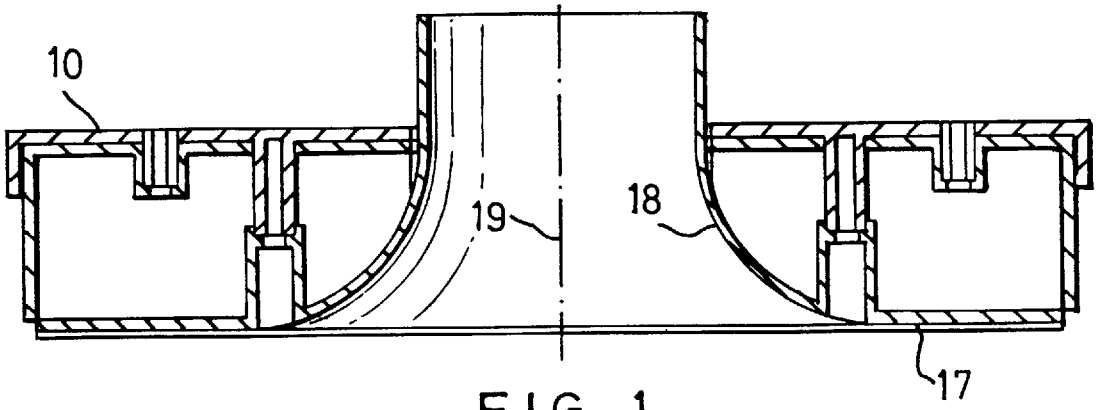
FIG. 1 is a sectional side view of the head.

Referring to the drawings, the head comprises hollow rectangular housings 10 and 11. An upper surface 12 of the head fits to an outer surface of a vacuum cleaner body 13. Strips of bristles 14 and 15 fit between the housings 10 and 11 and extend to form at remote ends of the bristles rubbing (i.e. brushing) contacts of the head. Plastic sponge rubber pads 14A and 15A are also held between the housings 10 and 11. A spacer 16 is mounted between the housing 11 and a bottom cover 17. The cover 17 has a curved central channel 18 that extends up from an inlet, along a central axis 19 of the vacuum cleaner, through the spacer 16 and the housings 10 and 11 to an outlet positioned adjacent the outer surface of the body 13. Dust and debris swept up by the bristles is therefore drawn through the channel 18 directly into the vacuum cleaner body, including, as the channel 18 has a generally large cross-sectional area, waste articles including cigarette ends and the like.

Figure 2:
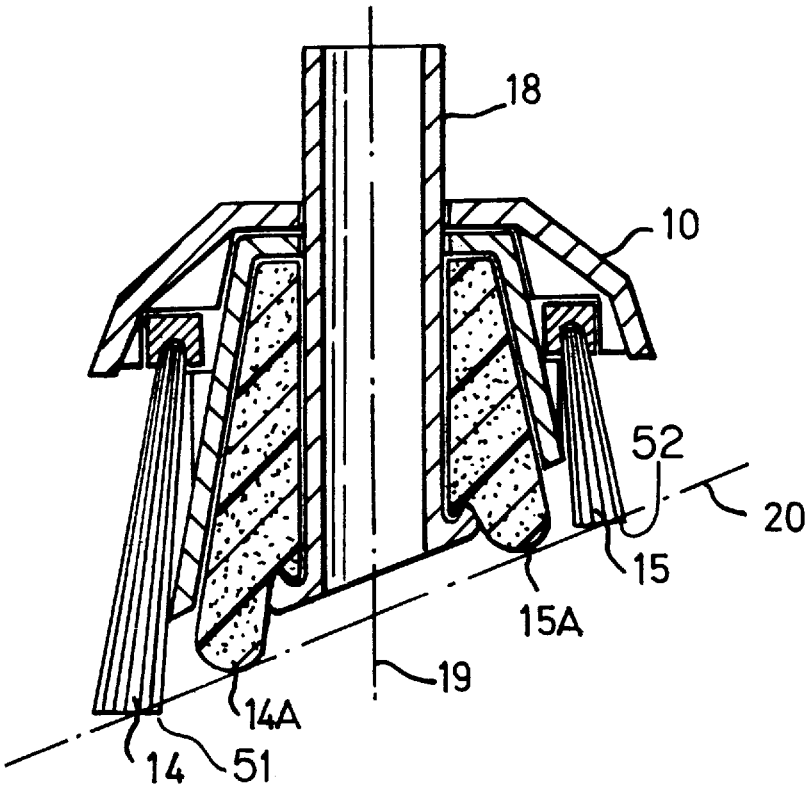
FIG. 2 is an end view of the head.
Figure 3:
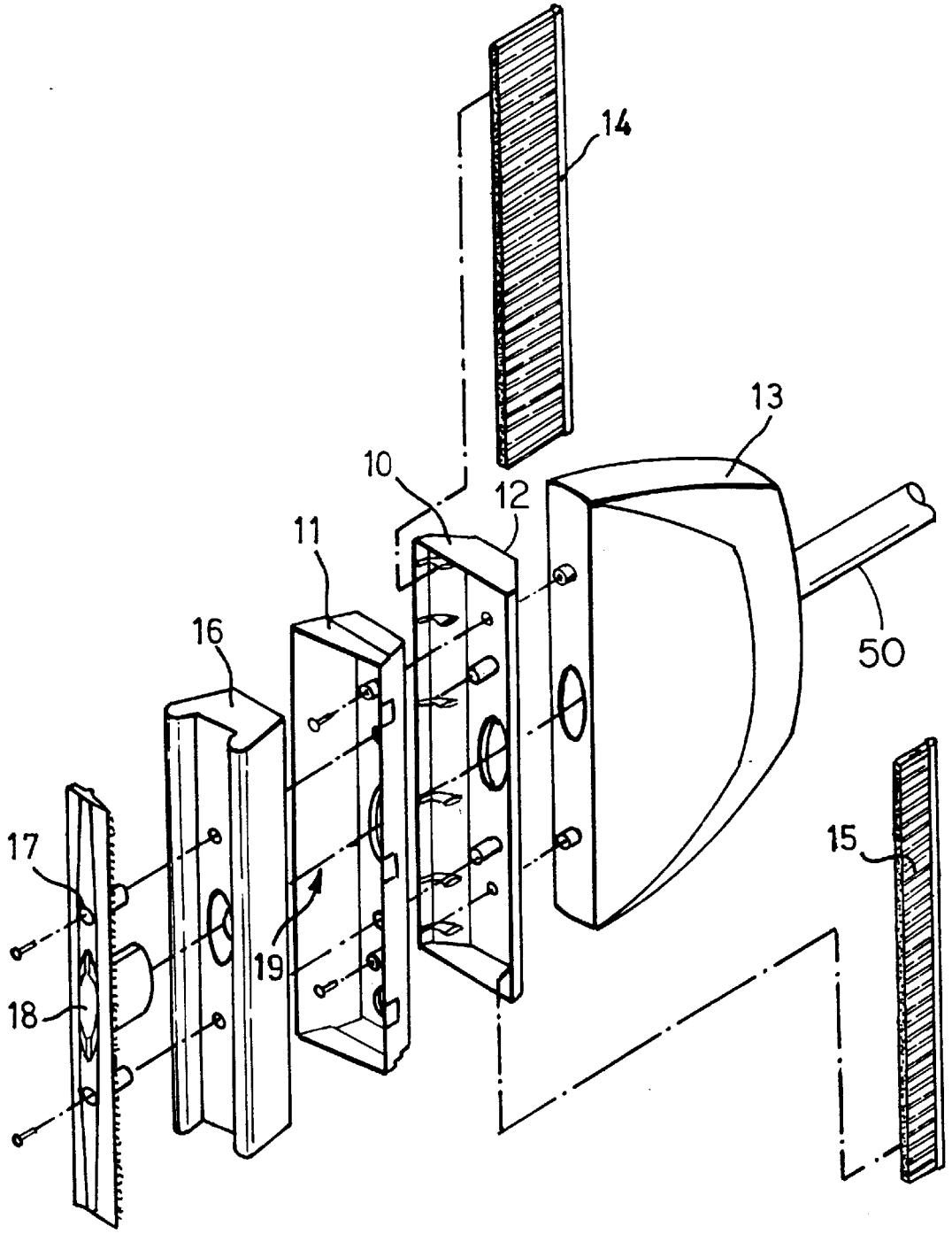
FIG. 3 is an exploded isometric view of the head.

It will be noted, as best shown in FIG. 2, that an imaginary plane 20 which joins the rubbing contacts or elements 51 and 52 provided by the strips 14 and 15 lies at an angle of approximately 70° with respect to the central axis 19. This means that when the vacuum cleaner body is manually manipulated directly (or via a rigid handle 15, (FIG. 3), attached to the body 13 opposite the head), a comfortable natural sweeping action is provided. This is provided while maintaining the remote ends of both strips 14 and 15 of bristles in contact with a swept surface. In other words, a comfortable orientation of the body 13 when supported manually, which is at or around 20° to the vertical, leads to efficient and "natural" sweeping by the bristles, and removal of the sweepings by the vacuum cleaner.

The bristles may be replaced or supplemented by strips of cloth or leather, or resilient material, such as sponge foam, that are supported with their exposed surfaces generally on the plane 20. That is to say, where different material strips are used, each strip is mounted so that its rubbing or contact surface lies at least generally on the plane 20. In this way the brushing and wiping, and combinations thereof, takes place efficiently and comfortably by holding the vacuum cleaner body with the central axis at about 20° to the vertical during the sweeping actions. It is also possible to have the bristles as described and a strip of foam or other rubbing material adjacent only the set of bristles 14, between the set 14 and the channel 18. This serves in any event to improve the suction effect of the vacuum cleaner in use.

We claim:

1. A vacuum cleaner head adapted to be attached directly to a vacuum cleaner body, said head comprising:

a generally rectangular hollow housing having a central axis, said hollow housing having an upper surface fitting against an outer surface of said body and a lower surface that provides rubbing elements contacting the ground in use, said rubbing elements lying in a plane at an angle from said central axis of approximately 70° and disposed along two opposing sides of said lower surface to form a gap between two opposing sides to allow dust and debris to enter said vacuum cleaner body through said head, said rubbing elements formed of bristles mounted in two rows to said head extending along said opposing sides.

2. A vacuum cleaner head according to claim 1, in which said rubbing elements further comprise at least one elongate resilient pad mounted parallel to said respective rows of bristles and closer to said central axis than either of said two rows of bristles.

3. A vacuum cleaner head according to claim 1, further comprising a central passage formed in said head having an inlet surface that lies generally on said plane.

4. A vacuum cleaner head according to claim 3, wherein said inlet is elliptical in cross section and centered about said central axis with a major axis of said ellipse extending between said rubbing elements.

5. A vacuum cleaner head according to claim 4, wherein said central passage extends across a substantial length of said head at said inlet and reduces in width to equal about one fifth of the length of said head at outlet of said central passage.

* * * * *